US005492141A

United States Patent [19]

Oberlander

[11] Patent Number: 5,492,141

[45] Date of Patent: Feb. 20, 1996

[54] PERSON STABILIZER FOR VEHICLE ROOFTOPS

[76] Inventor: James R. Oberlander, P.O. Box 1104, Eagle Point, Oreg. 97524

[21] Appl. No.: 308,269

[22] Filed: Sep. 19, 1994

[51] Int. Cl.[6] ..... A45B 1/00

[52] U.S. Cl. ..... 135/65; 182/3; 135/66

[58] Field of Search ..... 135/65, 66, 67, 135/72; 297/DIG. 10; 182/3

[56] References Cited

U.S. PATENT DOCUMENTS 2,757,388 8/1956 Chisholm ..... 135/65 X 5,092,426 3/1992 Rhodes ..... 182/3

5,295,498 3/1994 Van Meter et al. ..... 135/76 X

*Primary Examiner*—Lanna Mai

*Attorney, Agent, or Firm*—William H. Maxwell

[57] ABSTRACT

A person stabilizer for use on rooftops, especially recreational vehicle rooftops, and characterized by a lever system wherein a support lever swings upwardly from the roof level and is restricted to the area of the roof by a stop that precludes the lever from traversing over the roof edge, and a stop to retain the support lever in close spaced stored relationship to the roof, the installation of the stabilizer being reversible for installation at the right or left side of the rooftop.

18 Claims, 2 Drawing Sheets

PERSON STABILIZER FOR VEHICLE ROOFTOPS

BACKGROUND OF THE INVENTION

This invention relates to recreational vehicles and a safety device for persons negotiating a vehicle rooftop as may be required to service equipment such as ventilators, fans, antennas and air conditioners, and the like. The rooftops of these so called RV campers and motor homes are not normally intended for human support, although there are those with sun decks, and consequently most such vehicles are devoid of any safety features such as railings. Grab rails as such are low profile and ineffective in preventing a person from falling off the rooftop. Furthermore, when an insecure person ventures atop an RV roof without protective railings, his sense of balance is most likely to be affected and he is apt to misstep and lose his balance. It is this insecure and dangerous situation that this invention addresses and corrects. Accordingly, it is a general object of this invention to provide an apparatus for installation on a recreational vehicle rooftop for stabilizing a person standing and/or walking thereon throughout the area of said rooftop.

The human being is an upright creature having a distinctive ability to balance by adjusting the pressures applied at the toe and heel of his two feet. Since the distance ratio between toe-heel support and his height is great, and because his center of gravity is closer to his head, balance becomes critical when a person is in a position to fall from an elevated platform, such as an unprotected rooftop. And, a vehicle of the type under consideration is devoid of any substantial superstructure from which a person might be suspended, nor is the roof structure sturdy enough to withstand any great stress. Therefore, it is an object of this invention to provide apparatus that gives a person assurance of his balance which is then easily maintained. In actual practice, perfect balance of the human body can be attained with but a small amount of assistance. Therefore, it is an object of this invention to provide that assistance for the security of the person standing and/or walking upon the RV rooftop.

Recreational vehicles of the type under consideration are provided with roof access ladders, usually installed at the rear of the vehicle, either a right or left side installation, a left side installation being shown. Therefore, this assist apparatus is to be installed to function with respect to either right or left side ladders, it being an object of this invention to make this apparatus reversible without any alteration thereto.

The rooftop structures of recreational vehicles tend to be fragile, since they must be light weight with minimized rafters. Therefore, it is an object of this invention to provide a base member that is adaptable to a light weight roof and variably sized rafters. As will be described, the base member is rigid and of low profile.

The person support member that assists balance of a person is a swinging lever, having a grip that is accessible at the ladder, and which swings upwardly when a person grasps it for stability when ascending onto the rooftop, or which swings downward when descending onto the access ladder. It is therefor an object of this invention to provide means to pivot the lever from a lowered access position to an elevated standing position of the person on the rooftop. And further to provide for effective intermediate positions.

The aforesaid person support member in the form of a swinging lever is also a pivoted lever having a turret means for limited controlled rotation between fore and aft swinging modes. In practice, the turret means revolves between diametrically opposite fore and aft positions, the transition therebetween being accomplished when the support member is vertical. It is an object of this invention to provide turret means for these purposes.

Roadability is an object of this invention, to provide an apparatus that is self sufficient and requires no other fastening or securement other than installing the base onto the rooftop. In practice, stop means is provided to maintain the support member lever clear of the rooftop when it is out of use and in a down position, where it is secured by an over-center spring toggle means.

SUMMARY OF THE INVENTION

This is a person stabilizing device in the form of a self sufficient apparatus that is installed on the rooftop of a recreational vehicle for assisting the person to balance himself with the assurance of safety, when ascending, traversing the rooftop, and when descending therefrom. This safety device includes a base member that is permanently secured to the light weight roof structure, the base member being an elongated rigid strap that is fastened by means of adhesive and/or screws. A turret means is centrally located on the base member for rotatably carrying an upwardly swinging support member in the form of a lever having a hand grip at its free swinging end. The support member lever swings through an arc of 90° or more from either end of the base member, by rotating the turret 180°, thereby enabling a person to travel a substantial distance along the rooftop. A feature is the limited and controlled rotation of the turret means which restricts the support member to swing only over the rooftop, and not over the side of the roof. Another feature is the spring biased toggle action of a pivot means on which the support means lever swings from a horizontal stored position spaced above and parallel to the base member and underlying rooftop, The foregoing and various other objects and features of this invention will be apparent and fully understood from the following detailed description of the typical preferred form and application thereof, throughout which description reference is made to the accompanying drawings.

THE DRAWINGS

Figure 6:
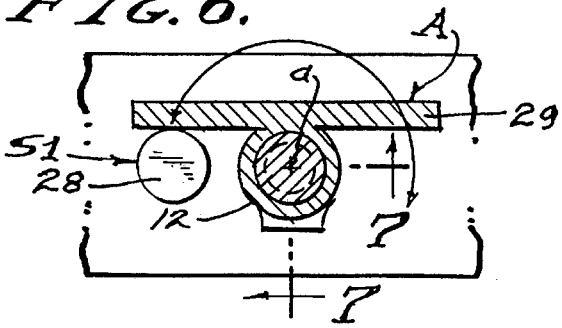
FIG. 6 is a plan section taken as indicated by line 6—6 on FIG. 5.
Figure 7:
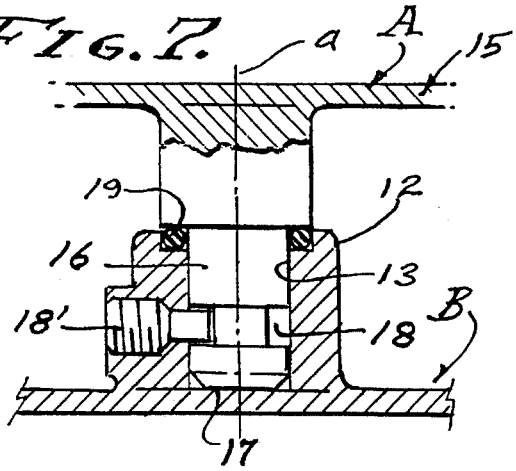

And, FIG. 7 is a detailed section taken as indicated by line 7—7 on FIG. 6.

PREFERRED EMBODIMENT

Figure 1:
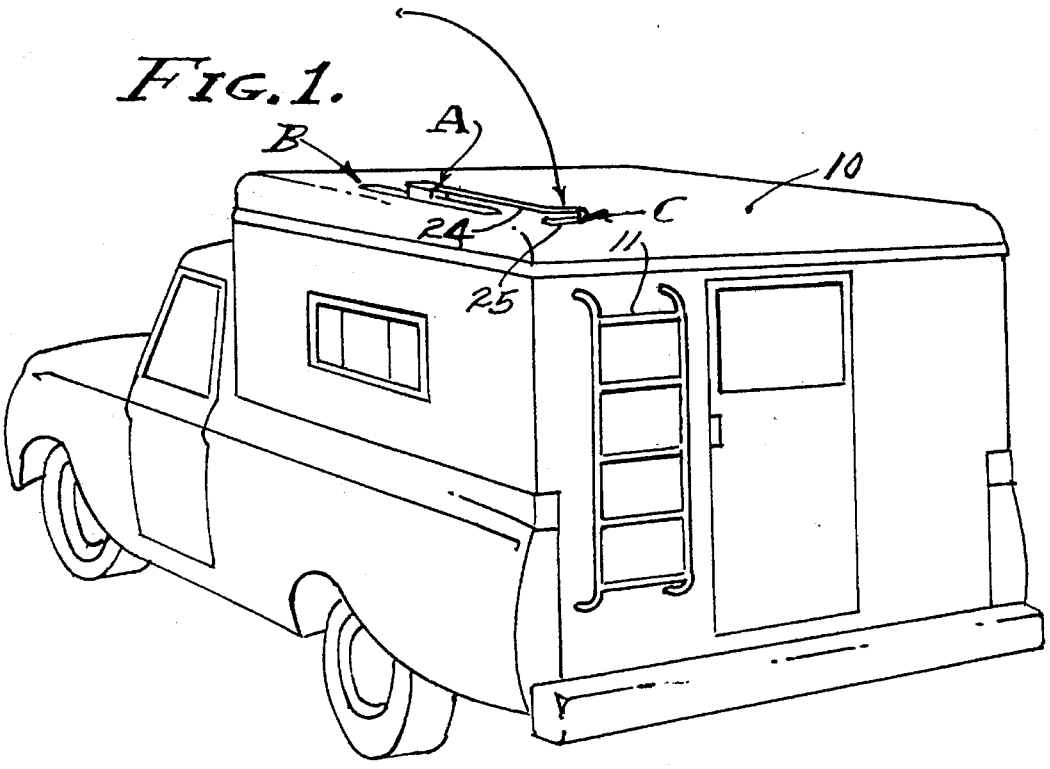
FIG. 1 is a perspective rooftop view of a camper having a left side ladder installation and with the stabilizer device of the present invention installed on the rooftop.
Figure 2:
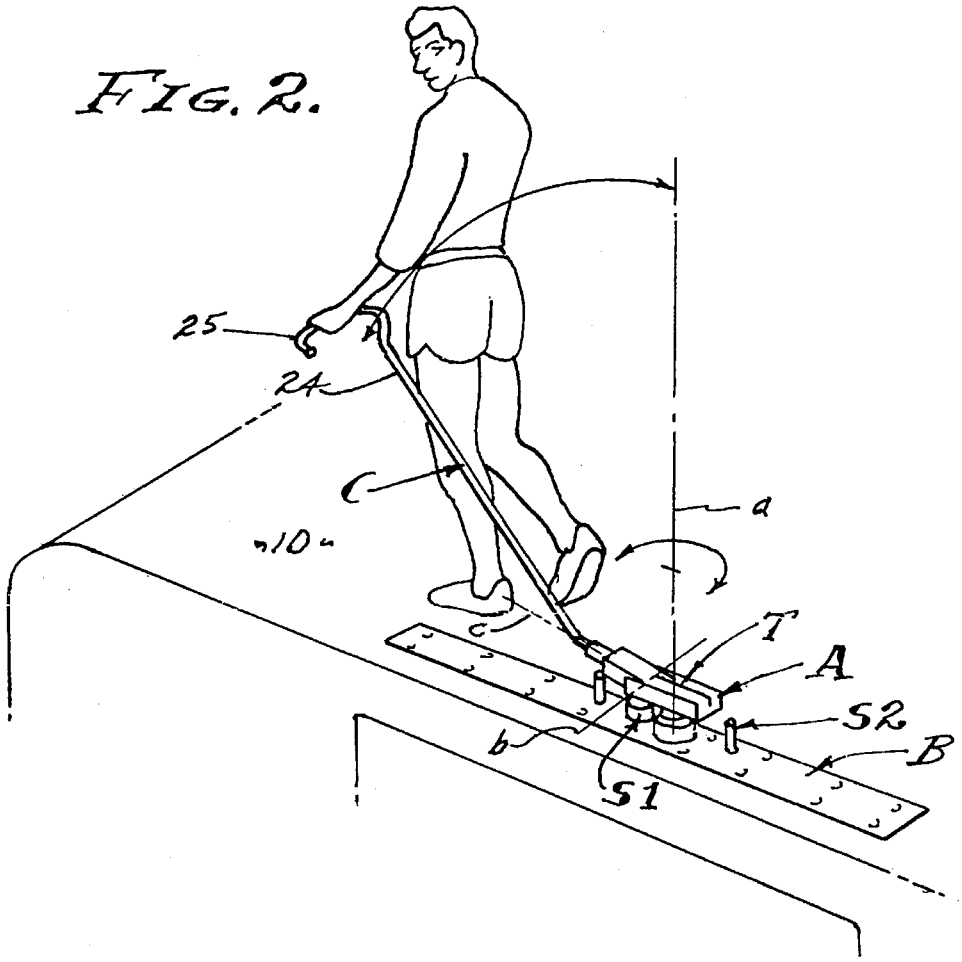
FIG. 2 is an enlarged perspective view illustrating a person being assisted by this stabilizer device, to assure his balance when traversing the rooftop.
Figure 3:
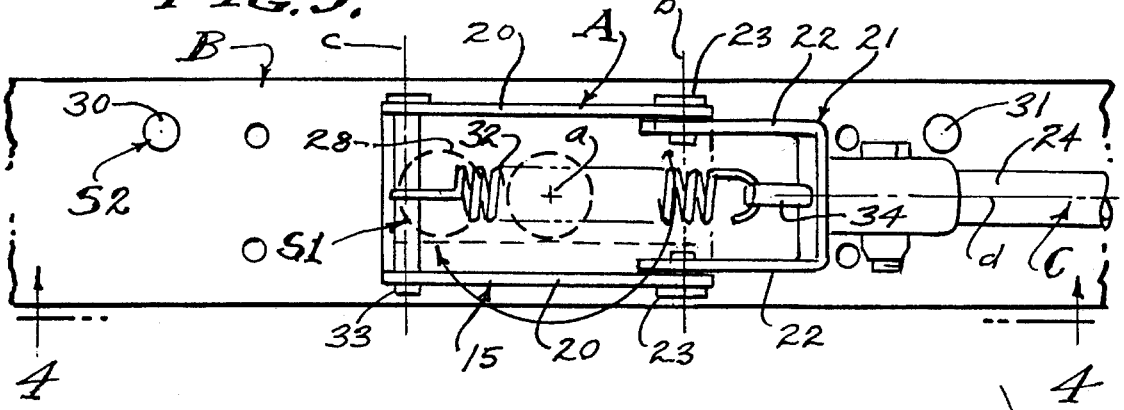
FIG. 3 is an enlarged plan view of the stabilizer device, positioned as it is shown in FIG. 1.
Figure 4:
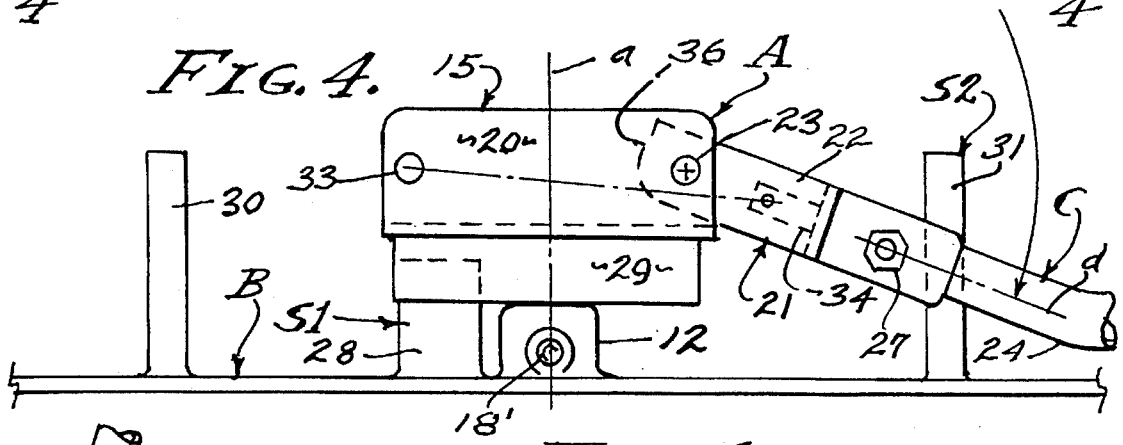
FIG. 4 is a side view in partial section taken as indicated by line 4—4 on FIG. 3.
Figure 5:
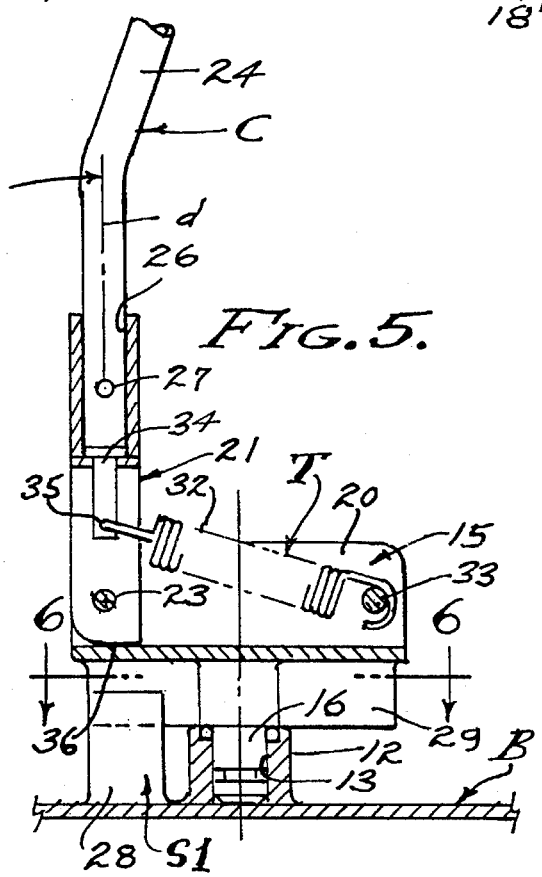
FIG. 5 is a view similar to FIG. 4, but showing the turret means rotated 180° and the support member elevated to a stopped position.

Referring now to the drawings, the stabilizing device of the present invention is a self sufficient apparatus comprised of a base member B adapted to be installed upon the light weight rooftop structure of a recreational vehicle, a turret means A for limited rotation about a vertical axis a, and a support means C for limited swinging on a horizontal axis b supported on the turret means. The base member B is asymmetrical for reversible installation at either side of the vehicle rooftop, and includes a first stop means S1 for restricting traverse of the support means C to the area of the rooftop, and a second stop means S2 for releasably restricting the support means C to a stored position aligned with the base member B. Also included is a spring biased toggle means T that yieldingly retrains the support means C in its stored position as shown in FIGS. 1, 3 and 4. Typical in-use positions of the support member C are shown in FIGS. 2 and 5.

The base member B is a low profile adapter in the form of a flat and rigid strap that is secured to a flat surface of the rooftop 10. Installation is at the side where the camper body has a ladder 11 for ingress to and egress from the rooftop. As shown, the base member B is an elongated strap forty inches long and three inches wide, with pairs of transversly spaced fastener holes at four inch intervals. This placement of fasteners enables securement to underlying rafters (not shown) spaced 12, 18, 24 and 32 inches apart. A double sided adhesive tape is applied (not shown) between the strap and rooftop, thereby securing the base and excluding moisture from the interface.

A bearing boss 12 is centered on the base member B and welded thereto as shown, to present an upwardly disposed cup-shaped cylindrical opening 13 on a vertically disposed axis a.

The turret means A as mounted on the bearing boss 12 and is comprised of a body 15 to carry the support means C, and a pivot pin 16 received to turn free in the opening 13 of the bearing boss 12. The lower terminal end 17 of the pivot pin has axial thrust engagement with the bottom of the cylindrical opening 13 which is the top face of the base strap. The pivot pin has a circumferential groove 18 to receive a dog-point of a screw 18' that retains a rotatable assembly comprised of the turret means and base member. And, the pivot pin also has a circumferential seal groove 19 to receive an O-ring that captures lubricant and excludes outside water etc.

In accordance with this invention, the turret means A carries the support means C on a vertically rotatable horizontal axis b to swing upwardly and downwardly. In its preferred form the body 15 of the turret means is of horizontal channel shape centered on the axis a and having side flanges 20 between which the support means C swings on the axis b. As shown, the inner end of the support member is rotatably carried by a fork 21 having a pair of legs 22 and one leg at each flange 20 secured by pivot pins 23 on the axis b. The support means C is preferably a tubular free swinging lever 24, fifty inches long with a hand grip 25 at its outer end.

This stabilizing device is merchandised in disassembled condition, the support means C featuring a socket 26 for attachment of the lever 24 to the fork 21. In practice, a screw fastener and nut 27 is engaged through the socket and lever to secure them in assembled condition as shown.

As thus far described the support means is carried on axis b to swing from a horizontally projected position to a vertically projected position. The inner end of the lever 24 is anchored by the fork 21 on the vertical axis a to rotate, whereby the lever 24 freely sweeps around a substantial portion of the rooftop. Accordingly, a person gripping the outer grip 25 of the support meaner C can steady himself, since the inner end of the lever 24 of the support member is anchored to the rooftop. Limited movement of the support means is by stop means S1 and S2 next described.

The stop means S1 is for restricting movement of the support means C within either side of the rooftop. Accordingly, free rotation on the vertical turret axis a is limited to 180° of rotation that traverses the rooftop area inside of the roof edge at which this stabilizing device is installed. Therefore, rotation outside of the rooftop edge is precluded. In practice, there is a stop post 28 on the base member B and a stop bar 29 on the body 15 of the turret means, the opposite ends of the stop bar 29 being alternately engageable with stop post 28 when the lever 24 is in the opposite 180° foremost and aft stop positions aligned with the base member B. As shown, the stop post 28 is at one side of the bearing boss 12, while the stop bar 29 is coextensive with and at one side of the turret means body 15.

The stop means S2 is for releasably restricting the support means C to either 180° alignment with the base member B. Accordingly, free rotation on the vertical turret means axis a is stopped when the aforesaid stop means S1 is effectively engaged in either of the alternate 180° positions. In practice, there is a pair of stop posts 30 and 31 on the base member B and each spaced radially from axis a and from the turret body 15 to engage with opposite sides of the support means lever 24. The posts 30 and 31 are positioned at one side of the base member B so that said base member is asymetrical for mounting placement purposes. The front post 30 opposes the foremost stop position of stop means S1, whereas the aft post 31 opposes the aft stop position of the stop means S1. Accordingly, the bar 29 of stop means S1 is secured in said foremost position by engagement of the lever 24 with the stop post 30 of the stop means S2, while the bar 29 of stop means S1 is secured in said aft position by engagement of the lever 24 with the stop post 31 of the stop means S2. A feature is the downward position of the support means lever 24 to engage either stop post 30 or 31, to alternately disengage the posts 30 and 31 when said lever is lifted so as to be released from a stopped position aligned with the base member. Thus, the support means C is released from either aligned stored condition, simply by lifting the lever 24.

Securement means T is provided for releasably securing the lever 24 of the support means C in a down stored condition closely spaced from and parallel to the base member B and rooftop 10. An over-center spring toggle means is preferred, comprised of a spring 32 operating between a fixed end anchor 33 on the body 15 of the turret means, and a live end pull point on the support means C. As above described, the body 15 is an upwardly open channel having spaced side flanges, the body 15 being elongated with the pivot axis b at one end and the anchor 33 at the other end. In practice, the anchor 33 is in the form of a pin on an axis c spaced from and parallel to the axis b, and at the same horizontal height above the base member B. As shown, the axes b and c are spaced 3½ inches, and the spring 32 is a tension spring hooked to the anchor pin on axis c, and with its live end hooked to a pull pin 34 carried by and within the legs 22 of the fork 21. The pull pin 34 is centered within the fork 21, along a projected axis d of the tubular lever 24, with an opening 35 at its terminal end to secure the hooked end of the spring 32. Said extended axis of the lever 24 intersects the swinging axis b and the opening 35 to receive the live end of spring 32 spaced radially therefrom a distance of approximately 1¼ inches.

The fork 21 has two stopped positions, a secured down stored position as shown in FIGS. 1 and 4, and a secured up operating position as is shown in FIG. 5. A feature is that the fork 21 and lever 24 carried thereby are free to rise to any angular position between "down" and "up", as may be required (see FIG. 2). The secured down position is obtained by stopping the fork 21 below the plane of axes b and c, for example 20° over center and thereby securing the lever 24 above and parallel to the base member B. In practice, there is a 20° bend in the lever 24 to establish this horizontal "down" position of the support member and its lever 24.

The fork 21 also stops against the underlying end of the body 15 (see FIG. 4). Alternately, the "up" position of the fork 21 is obtained by applying the tension of the spring 32, the fork 21 being stopped by its legs 22 flattened at 36 to engage the body 15 (see FIG. 5), the lever 24 swinging beyond vertical (see FIG. 5).

From the foregoing it will be understood how this Person Stabilizer is constructed and installed to be usefully operated. Its primary purpose is to assist a person when ascending onto or depending from a rooftop, and particularly the rooftop of a recreational vehicle such as a camper or the like. A feature is the mounting of the base member remote from the point of ingress or egress and the swinging-rotating functions of the device, whereby a person is assisted while traversing the rooftop area, the grip of the support means, extending approximately four feet when raised, and a person's arm extending more than two feet from the shoulder, a total distance of approximately six feet radius. Consequently, a person can travel more than twelve feet fore and aft, and more than six feet transversely. And, a person's reach from finger tip to finger tip can be as much as six feet, which adds approximately four feet to the six foot radius mentioned above. It is possible therefore, with the Person Stabilizer dimensioned as shown, for a person to reach approximately ten feet from the pivot axis a, while maintaining his balance by grasping the support means grip.

Having described only the typical preferred form and application of my invention, I do not wish to be limited or restricted to the specific details herein set forth, but wish to reserve to myself any modifications or variations that may appear to those skilled in the art, as set forth within the limits of the following claims.

I claim:

1. A stabilizing device for assisting a person to attain assurance and steadiness of balance within a limited area, and including;

a base member to be fastened to a standing surface of the limited area and having a bearing on a vertically disposed axis, a turret means having a pivot carried by the bearing to rotate on said vertical axis and having a horizontally disposed axis to rotate therewith, and a support means in the form of a lever having a pivot at one end, the support means being carried on the horizontal axis of the turret means to swing upward and downward, there being a hand grip at the other end of the lever remote from the horizontal turret means axis, whereby a person holding the grip is assisted in ascent and descent and when moving about said limited area.

2. The person stabilizing device as set forth in claim 1, wherein the base member is of low profile in the form of a flat and rigid strap interfaced with the standing surface of the limited area.

3. The person stabilizing device as set forth in claim 1, wherein the bearing on the base member and the turret means pivot are retained as a rotatable assembly by a dog-point screw received in a circumferential groove in the pivot.

4. The person stabilizing device as set forth in claim 1, wherein the bearing on the base member opens upwardly to receive the turret means pivot at a seal to retain lubricant therein and to exclude outside elements.

5. A stabilizing device for assisting a person to attain assurance and steadiness of balance within an edge of a limited area, and including;

a base member to be fastened to a standing surface at said edge of the limited area and having a bearing on a vertically disposed axis, a turret means having a pivot carried by the bearing to rotate on said vertical axis and having a horizontally disposed axis to rotate therewith, a support means in the form of a lever having a pivot at one end, the support means being carried on the horizontal axis of the turret means to rotate therewith and to swing upward and downward, and stop means for limiting rotation of the turret means to restrict movement of the support means lever within said edge of the limited area, there being a hand grip at the other end of the lever remote from the horizontal turret means axis, whereby a person holding the grip is assisted in ascent and descent and when moving about within said edge of the limited area.

6. The person stabilizing device as set forth in claim 5, wherein the stop means is for limiting rotation of the turret means to restricted movement of the support means lever to 180° within said edge of the limited area.

7. The person stabilizing device as set forth in claim 5, wherein the stop means is comprised of a stop post on the base member, the stop post being engaged by a stop bar on the turret means.

8. The person stabilizing device as set forth in claim 7, wherein the stop post is alternately engaged by opposite sides of the stop bar on the turret means.

9. A stabilizing device for low profile retraction from which is lifted for assisting a person to attain assurance and steadiness of balance within an edge of a limited area, and including;

a base member to be fastened to a standing surface at said edge of the limited area and having a bearing on a vertically disposed axis, a turret means having a pivot carried by the bearing to rotate on said vertical axis and having a horizontally disposed axis to rotate therewith, a support means in the form of a lever having a pivot at one end, the support means being carried on the horizontal axis of the turret means to rotate therewith and to swing upward and downward, a first stop means for limiting rotation of the turret means to restrict movement of the support means lever within said edge of the limited area, and a second stop means for releasably restricting the support means lever opposed to said first stop means, there being a hand grip at the other end of the lever remote from the horizontal turret means axis, whereby a person holding the grip and lifting the lever from the second mentioned stop means is assisted in ascent and descent and when moving about within said edge of the limited area.

10. The person stabilizing device as set forth in claim 9, wherein the first stop means is comprised of a stop post against which the turret means is rotated and with the lever carried thereby in swinging alignment with the base member.

11. The person stabilizing device as set forth in claim 9, wherein the second stop means is comprised of a stop post against which the lever is stopped when in a lowered retracted position and free to move when lifted from said retracted position.

12. The person stabilizing device as set forth in claim 9, wherein the first stop means is comprised of a stop post against which the turret means is rotated and with the lever carried thereby in swinging alignment with the base member, and wherein the second stop post means is comprised of a stop against which the lever is stopped in said alignment with the base member in a lowered retracted position and free to rotate the turret means when lifted from said retracted position.

13. The person stabilizing device as set forth in claim 9, wherein the first stop means is comprised of a stop post projecting from the base member and against which a stop bar on the turret means is rotated with the lever carried thereby in swinging alignment with the base member.

14. The person stabilizing device as set forth in claim 9, wherein the second stop means is comprised of a stop post projecting from the base member and against which the lever is stopped when in a lowered retracted position and free to move when lifted from said retracted position.

15. The person stabilizing device as set forth in claim 9, wherein the first stop means is comprised of a stop post projecting from the base member and against which a stop bar on the turret means is rotated with the lever carried thereby in swinging alignment with the base member, and wherein the second stop means is comprised of a stop post projecting from the base member and against which the lever is stopped in said alignment with the base member when in a lowered retracted position and free to rotate the turret means when lifted from said retracted position.

16. A retractile stabilizing device for assisting a person to attain assurance and steadiness of balance within a limited area, and including:

a base member to be fastened to a standing surface of the limited area and having a bearing on a vertically disposed axis, a turret means having a pivot carried by the bearing to rotate on said vertical axis and having a horizontally disposed axis to rotate therewith, a support means in the form of a lever having a pivot at one end, the support means being carried on the horizontal axis of the turret means to swing upward and downward, and securement means for releasably securing the lever in a retracted stored condition close to the base member, there being a hand grip at the other end of the lever remote from the horizontal turret means axis, whereby a person holding the grip is assisted in ascent and decent and when moving about said limited area.

17. The retractile stabilizing device as set forth in claim 16, wherein the securement means is an over-center spring toggle means comprised of a spring with a fixed end anchored to the turret means and with a live end to a pull point on the lever.

18. The retractile stabilizing device as set forth in claim 16, wherein the securement means is an over-center spring toggle means comprised of a tension spring with a fixed anchor in a horizontal plane with and spaced from the horizontal swing axis of the lever, of a live end of the spring connected to a pull point on the lever spaced from the horizontal swing axis of the lever, and of a stop means for over-center stopped positioning of the lever in said condition close to the base member.

* * * * *